US006513517B1

(12) United States Patent
Jiang et al.

(10) Patent No.: US 6,513,517 B1
(45) Date of Patent: Feb. 4, 2003

(54) STRUCTURE OF OVEN RACK OF A GAS STOVE

(75) Inventors: Jung-Jye Jiang, Taipei (TW); Te-Yang Chiang, Taipei (TW)

(73) Assignee: Hanaqua Tech Inc., Taipei (TW)

( * ) Notice: Subject to any disclaimer, the term of this patent is extended or adjusted under 35 U.S.C. 154(b) by 0 days.

(21) Appl. No.: 09/714,281

(22) Filed: Nov. 17, 2000

(51) Int. Cl.[7] ..... F24C 15/16

(52) U.S. Cl. ..... 126/337 A; 312/319.7; 312/410

(58) Field of Search ..... 126/273 R, 332, 126/337 A, 337 R, 339; 312/236, 312, 319.7, 410

(56) References Cited

U.S. PATENT DOCUMENTS

| | | | | |
|---|---|---|---|---|
| 2,818,011 A | * | 12/1957 | Fleming et al. | 126/273 R |
| 3,043,290 A | * | 7/1962 | Smith | 126/337 A |
| 4,220,133 A | * | 9/1980 | Way, Jr. | 126/337 A |
| 5,429,043 A | * | 7/1995 | Becker | 126/337 A |

* cited by examiner

*Primary Examiner*—Sara Clarke
(74) *Attorney, Agent, or Firm*—Leong C. Lei

(57) ABSTRACT

The present invention relates to an improved structure of an oven rack of a gas stove, employing a controller to automatically memorize and learn to change the flame from a gas source, such that when the height of the oven rack is adjusted, the flame is also adjusted in such a way that the flame at the bottom of a cooking utensil is always at the best position to provide maximum heating effectiveness.

2 Claims, 3 Drawing Sheets

STRUCTURE OF OVEN RACK OF A GAS STOVE

BACKGROUND OF THE INVENTION (a) Technical Field of the Invention

The present invention relates to an oven rack of a gas stove, and in particular, an oven rack which can be elevated to provide maximum heating effectiveness of the gas stove.

(b) Description of the Prior Art

Most of the gas stoves available in the market have a fixed height oven rack. In other words, the height of the oven rack is fixed and cannot be adjusted to accommodate the objective of heating with respect to the height of the heating source. For instance, certain types of cooking may require lower flame. The flame reaching the bottom of a cooking utensil will differ in intensity , and the heat transfer of the flame will also vary. In order to improve the best heat transfer efficiency, the flame has to be in contact with the bottom surface of the heating utensils consistently and constantly while cooking.

In accordance with the present invention, the improved structure of an oven rack of a gas stove can automatically memorize and learn to control a flame by a controller and to adjust simultaneously the height of the oven rack the gas stove so as to provide the flame in the best position to heat the cooking utensils, and to achieve the maximum heating efficiency of the gas stove.

SUMMARY OF THE INVENTION

Accordingly, it is an object of the present invention to provide an improved structure of an oven rack of a gas stove comprising an upper oven rack, a lower oven rack, a wedge-shaped elevating means, a power switch and a controller, wherein the upper oven rack which is a structure to support a cooking utensil, including four hollow tubes and a plurality of horizontal connected rods, the upper horizontal connected rods connect the tube ends of the four hollow tubes and a pad is mounted at the tube ends and forms the area supporting the cooking utensil, the lower horizontal connected rods are connected to the hollow tubes somewhere at the middle position thereof, and corresponding connected rods are mounted together with the hollow tubes and the hollow tubes can rotate freely and become a rolling shaft. The horizontal surface of the lower connected rods is provided with a center circular ring having internal screw threads, which is mounted by the connected rods positioned at the four corners thereof, the heating core of the gas stove is mounted in between the upper horizontal connected rod and the lower connected rod of the upper oven rack, and there is no contact with the upper oven rack, and independently mounted at the base plate of the lower oven rack and is connected to a gas supply tube, in order to avoid air current affecting the flame, and the left, right and rear side of the upper oven rack are provided with side boards; the upper oven rack has four vertical rods mounted on the base plate, and the hollow rods are exactly vertically mounted to the vertical rods and can slide smoothly; the wedge-shaped elevating means includes two wedge blocks with rollers and the wedge blocks are provided with internal screw threads, a screw rod having a positive direction guiding screw thread and a reverse direction screw thread to pass through the blocks forming into an integral unit, one end of the screw rod is connected to a motor which is connected to the controller by means of a control wire to respond in accordance with signals. The power switch is provided with a rotating knob and the knob is used to control the flame, and at the same time, a variable resistance within a potential meter records the voltage at the maximum flame and at the minimum flame.

Yet another object of the present invention is to provide an improved structure of an oven rack of a gas stove, wherein the height of the oven rack can be easily elevated to provide maximum heating effect.

DETAILED DESCRIPTION OF THE PREFERRED EMBODIMENT

Figure 1:
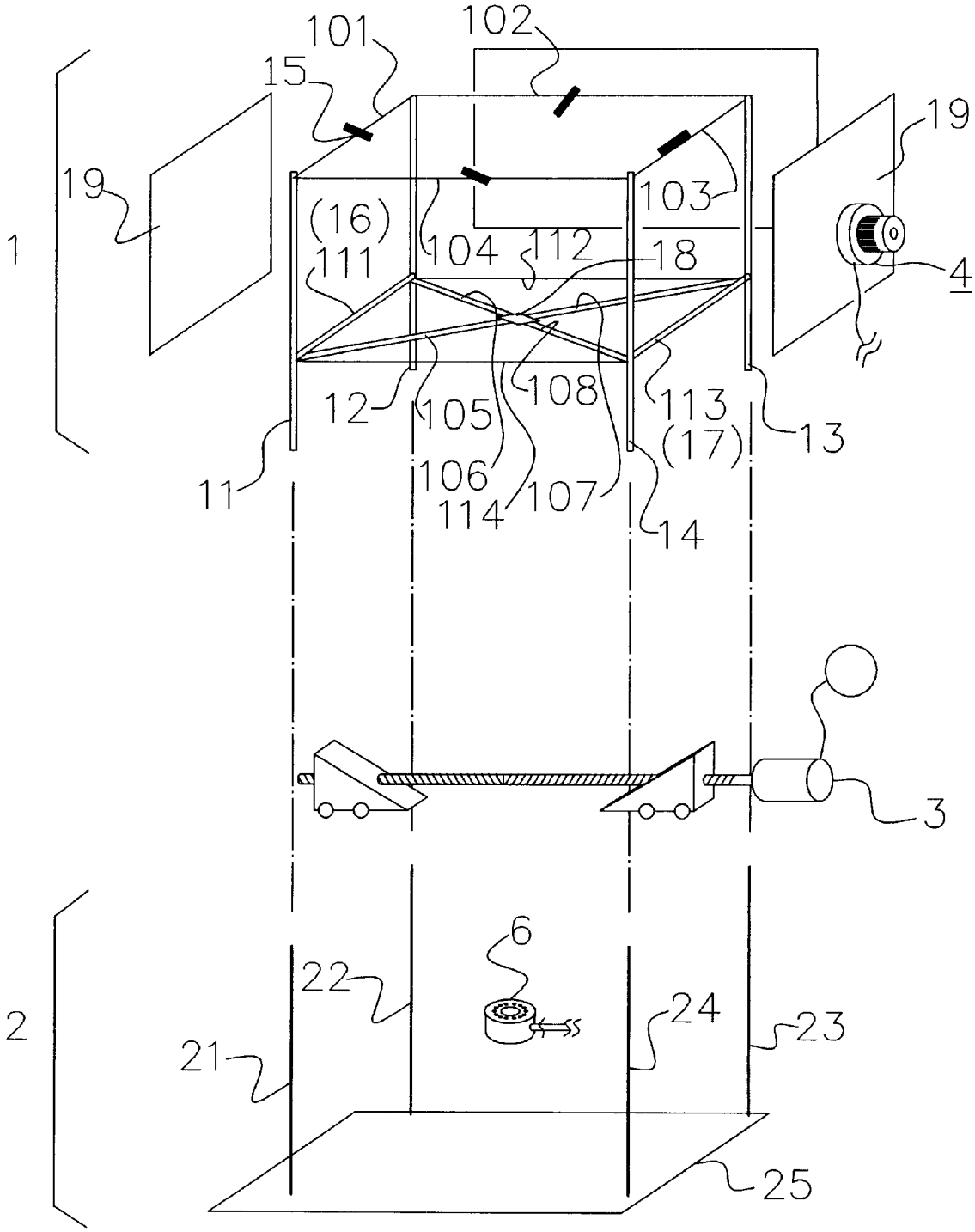
FIG. 1 is a schematic view of the oven rack of the present invention.

Referring to FIG. 1, there is shown an improved structure of an oven rack of a gas stove comprising an upper oven rack 1, a lower oven rack 2, a wedge-shaped elevating means 3, a power switch 4 and a controller 5, wherein (a) the upper oven rack 1, which is a structure to support a cooking utensil, including four hollow erect tubes 11, 12, 13, 14 and a plurality of horizontal connected rods, the upper horizontal connected rods 101, 102, 103, 104 connected to the tube ends of the four hollow erect tubes 11, 12, 13, 14. A pad 15 is mounted at the upper rods and is the area to support the cooking utensil. The lower horizontal connected rods 111, 112, 113, 114 are connected to the hollow erected tubes 11, 12, 13, 14 somewhere at the middle position thereof, and corresponding connected rods 111, 113 are mounted into the hollow tubes and the hollow tubes can rotate freely and become a rolling shaft 16, 17. The horizontal surface of the lower connected rods is provided with a center circular ring 18 having internal screw threads, which is mounted by the connected rods 105, 106, 107, 108 positioned at the four diagonal corners. The heating core 6 of the gas stove is mounted in between the upper horizontal connected rod and the lower connected rod of the upper rack, and there is no contact with the upper rack, and is independently mounted at the bottom plate 25 of the lower rack and is connected to a gas supply tube. In order to avoid air current impact on the flame the left, right and rear side of the upper rack is provided with side boards.

The lower rack has four vertical rods 21, 22, 23, 24 mounted on the base plate 25, and the hollow erected rods 11, 12, 13, 14 are exactly vertically mounted to the vertical rods 21, 22, 24 and can slide smoothly.

Figure 2:
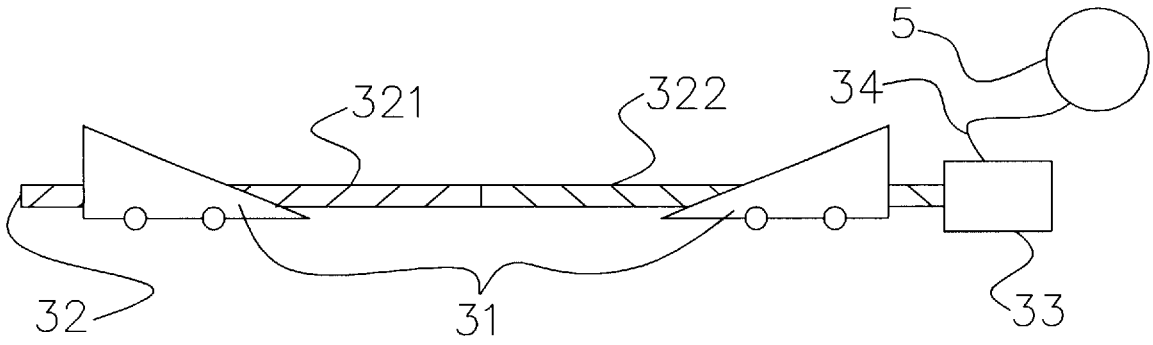
FIG. 2 is a schematic view illustrating the wedge-shaped elevating means of the present invention.

Referring to FIG. 2, there is shown the wedge-shaped elevating means 3 including two wedge blocks 31 with rollers and the wedge blocks 31 which are provided with internal screw threads, screw rod 32 having a positive direction guiding screw thread 321 and a reverse direction screw thread 322 to pass through the blocks 31 forming into an integral unit. One end of the screw rod 32 is connected to a motor 33 which is then connected to a controller 5 by means of a control wire 34 to respond in accordance with the signals.

The entire wedge-shaped elevating means 3 is mounted at the base plate 25 of the lower rack, the lower position of the upper rack. When the four hollow tubes of the upper rack are mounted into the vertical rod of the lower rack, the two roller shafts 16, 17 of the upper rack are exactly urged at the two wedge blocks.

Figure 3:
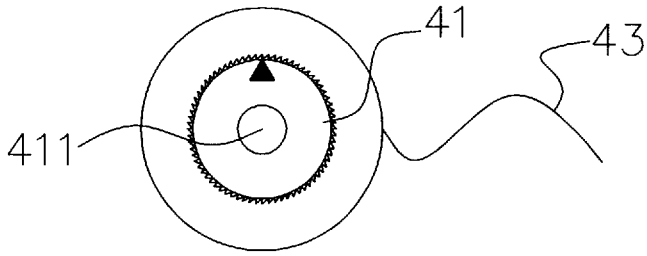
FIG. 3 is the external view of the power switch of the present invention.

In accordance with the present invention, when the oven rack is to be operated, the rotating knob 41 of the power switch 4 is used to control the flame, as shown in FIG. 3. A potential meter is mounted within the rotating knob 41 and based on the potential difference theory, wherein the rotating of the rotating knob 41 can control the size of the flame. The variable resistance within the potential meter can detect the change of potential and by means of wires 43, the change of voltage is transmitted to the control 5 for recording. The controller can determine the voltage at the maximum flame and the voltage at the minimum flame.

In accordance with the present invention, the above controller 5 obtains data through the wires and controls the motor 33 to rotate in either a clockwise or counterclockwise direction. The control signals are transmitted to the motor 33 by means of control wires 34. When the knob 41 is rotated in a left direction to cause the flame to become large, the signal of the potential meter becomes stronger and the controller 5 causes the motor 33 to rotate positively. At this instance, the positive direction guiding screw rod 321, and the reverse direction guiding screw rod 322 drive the wedge-shaped block 31 to move to the center. At this instance, the upper rack 1 at the wedge-shaped block will move upward as the wedge-shaped block moves towards the center. Thus the height of the upper rack is elevated. That is, the distance between the heating core and the base of the cooking utensil increases such that when the flame becomes larger, the flame can still have good contact with the bottom of the cooking utensil. If the rotating knob rotates toward the right, the flame becomes smaller and the signal of the potential meter becomes weak. The controller causes the motor to rotate in an opposite direction which causes the positive direction guiding screw rod 321 and the reverse direction guiding screw rod 322 to drive the wedge-shaped block 31 to move toward the two lateral sides. At this instance, the upper rack 1 will be lowered as a result of the wedge-shaped block 31 moving outwards and sliding downwards along the sloping surface. Thus, the flame will become small, but the flame will still have good contact with the bottom of the cooking utensil to provide best heat-transfer.

In accordance with the present invention, by means of the change of potential at the potential meter when the rotating knob is rotated, and the memory learning of the control software within the controller, the present invention can be employed in various types of gas pressure sources and with only one onsite operation, the obtained learning data can be set within the software of the controller. If the user wants to correct the learning data, the set button 411 of the rotating knob 41 can be re-set based on a different gas supply source to improve the efficiency of heat-transfer.

Figure 5A:
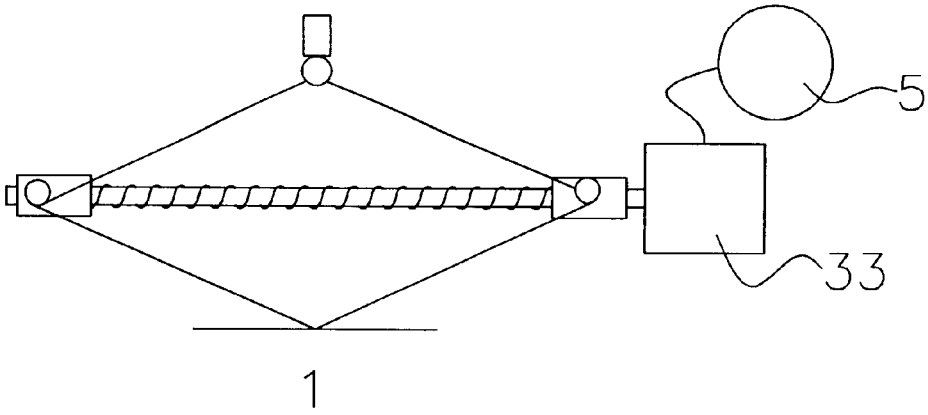
FIG. 5A is a foldable type elevating means of the present invention.
Figure 5B:
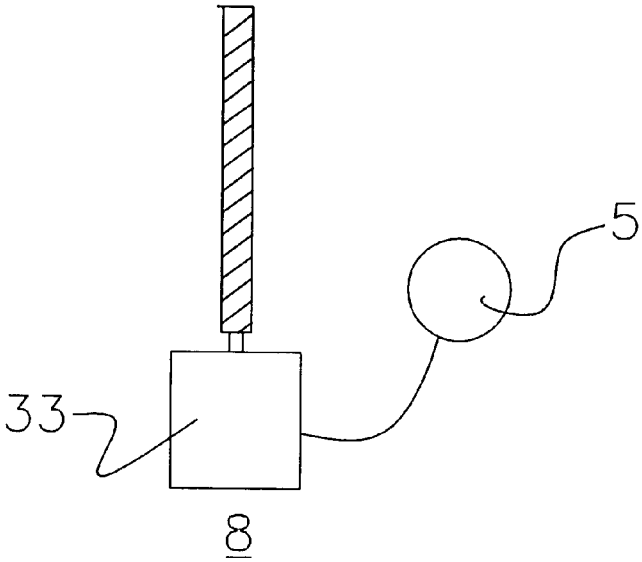
FIG. 5B is a screw rod type elevating means of the present invention.

In addition, in accordance with the present invention, the means for elevating the height of the oven rack is not only restricted to the wedge-shaped elevating means. As shown in FIG. 5, the elevating means may be a foldable elevating means 7 or screw rod type elevating means to act on the center ring. This will also cause the upper rack to move up or down.

Figure 4:
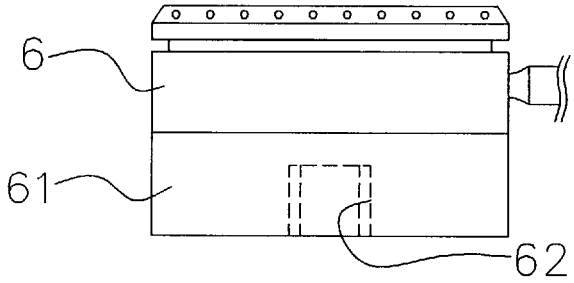
FIG. 4 is a structural view of the heating core and the core seat of the present invention.

If the oven rack is not an elevating or a lowering structure, then the heating core can be mounted onto a core seat 61 having an internal thread 62 (refer to FIG. 4). In accordance with the present invention, the foldable elevating means 7 or screw-rod type elevating means 8 can be employed to provide elevation movement.

In view of the above, the present improved structure of an oven rack of a gas stove can automatically memorize and learn the flame changes by the controller. When the flame of the stove is adjusted, the height of the oven rack is automatically adjusted such that the flame is at a best position below the bottom of the cooking utensil. Therefore, it provides the best efficiency in utilization of energy.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

We claim:

1. A gas stove oven rack comprising:

an upper oven rack for supporting a cooking utensil, the upper oven rack includes four hollow tubes and a plurality of upper horizontal connected rods and lower horizontal connected rods, the upper horizontal connected rods connect ends of the hollow tubes, pads are connected to the upper horizontal connected rods for supporting the cooking utensil, the lower horizontal connected rods are connected to the hollow tubes at a middle position thereof, the lower horizontal connected rods form a horizontal surface, the horizontal surface is provided with a center circular ring having internal screw threads;

a lower oven rack including a base plate and vertical connected rods mounted on the base plate, the hollow tubes of the upper oven rack slide smoothly on the vertical connected rods;

a heating core is mounted between the upper and lower horizontal connected rods and does not make contact with the upper oven rack, the heating core is independently mounted at the base plate of the lower oven rack and is connected to a gas supply tube;

side boards are mounted at the left, right and rear sides of the upper oven rack to avoid air currents affecting the flame;

a wedge-shaped elevating means including a screw rod and two wedge blocks with rollers, the wedge blocks are provided with internal screw threads and are mounted on the screw rod, one end of the screw rod is connected with a motor, the motor is connected to a controller by a control wire; and a power switch, the power switch is provided with a rotating knob, a potential meter is mounted within the rotating knob, such that rotation of tile rotating knob controls the size of the flame.

2. The gas stove oven rack of claim 1, wherein the wedge-shaped elevating means is positioned on the base plate, and two of the lower horizontal connected rods are mounted to the hollow tubes to freely rotate, the two freely rotating lower horizontal connected rods are urged by the two wedge blocks.

* * * * *